United States Patent [19]

Sakamaki et al.

[11] 4,286,933

[45] Sep. 1, 1981

[54] ROTARY VANE PUMP WITH PAIRS OF END INLET OR OUTLET PORTS

[75] Inventors: Hiroshi Sakamaki, Utsunomiya; Toshiyuki Maeda, Agoe; Fumihiro Ushijima; Tadashi Saitou, both of Toyota, all of Japan

[73] Assignee: Toyota Jidosha Kogyo Kabushiki Kaisha, Toyota, Japan

[21] Appl. No.: 45,813

[22] Filed: Jun. 5, 1979

[30] Foreign Application Priority Data

Jun. 9, 1978 [JP] Japan ..... 53/69491

[51] Int. Cl.[3] ..... F04C 27/00; F04C 29/00

[52] U.S. Cl. ..... 418/15; 418/133; 418/153

[58] Field of Search ..... 418/15, 131–135, 418/153, 156, 259, 268

[56] References Cited

U.S. PATENT DOCUMENTS

| | | | |
|---|---|---|---|
| 3,194,168 | 7/1965 | Rosaen | 418/132 |
| 3,311,064 | 3/1967 | Eichele et al. | 418/133 |
| 3,491,699 | 1/1970 | Yowell | 418/268 |
| 3,632,238 | 1/1972 | Searle | 418/15 |

FOREIGN PATENT DOCUMENTS

| | | | |
|---|---|---|---|
| 600324 | 4/1978 | U.S.S.R. | 418/131 |

*Primary Examiner*—John J. Vrablik

*Attorney, Agent, or Firm*—Sughrue, Mion, Zinn, Macpeak & Seas

[57] ABSTRACT

A rotary fluid pump of the type having a housing body and a pair of recessed end heads assembled to opposite ends of the housing. A pair of resilient sealing plates may be disposed between the side of the housing and the recessed end heads to define a rotor chamber having a rotor with slidable vanes mounted thereon. Fluid inlet and outlet ports adapted to communicate with the rotor chamber are formed either in the sealing plates or in the end heads to provide pairs of inlet and outlet ports.

6 Claims, 9 Drawing Figures

ROTARY VANE PUMP WITH PAIRS OF END INLET OR OUTLET PORTS

BACKGROUND OF THE INVENTION

1. Field of the Invention

This invention relates to a rotary fluid pump in which fluid intake, compression and discharge operations are carried out by the vane movements with the rotation of a rotor. More particularly, the invention relates to a type thereof wherein fluid inlet and/or outlet ports are symmetrically opened at both sides of the rotor chamber.

2. Description of the Prior Art

Within the prior art rotary fluid pumps have been provided with a rotor chamber defined between a main body of a stator housing and end heads assembled at both side faces of the main body. A rotor is rotationally supported within the rotor chamber, and is formed with a plurality of radial vane grooves in which equal plurality of vanes are slidingly engaged. These vanes are rotated by the rotation of the rotor, during which the vanes are moved radially outwardly by the centrifugal force to contact the radially outer ends of the vanes with an inner peripheral surface of the main body. Hence fluid enters from a fluid inlet port into the rotor chamber and is discharged toward a fluid discharge through a fluid outlet port.

Also known is an another type of a rotary fluid pump having a pair of recessed end heads assembled at opposite ends of the housing to form a pump cavity therewith. A pair of resilient sealing plates are individually disposed between the ends of the housing and the recessed end heads to divide the pump cavity into a pair of end chambers defined by the end recessed and the sealing plates and an intermediate rotor chamber defined by the sealing plates. A plurality of vanes are slidingly disposed in an equal plurality of grooves radially formed in a rotor mounted on a drive shaft within the rotor chamber.

According to these conventional rotary fluid pumps, a fluid inlet port is formed in one of the end heads in the former type or formed in one of the sealing plates in the latter type, and fluid outlet port is formed in the other end head or the other sealing plate. Alternatively, fluid inlet and outlet ports are formed in one of the end heads or sealing plates, and no ports are formed in the other end head or sealing plate.

Such conventional pumps have drawbacks. Since fluid is introduced into the rotor chamber from the inlet port formed at one side of the rotor chamber, the vanes are subject to non-uniform intake pressure. Furthermore, since fluid is discharged through the outlet port formed at one side of the rotor chamber, the vanes are also subject to non-uniform fluid discharge pressure. Therefore during operation, the vanes tend to be locally worn out due to non-uniform pressure applied thereto, to thus degrade pump efficiency.

SUMMARY OF THE INVENTION

It is therefore an object of this invention to overcome the above-mentioned drawbacks and to provide an improved rotary fluid pump.

It is another object of this invention to provide a rotary fluid pump in which fluid intake and discharge pressure is uniformly applied to the vanes to thereby prevent the vanes from local wear, to thus maintain pump efficiency and service life thereof.

These and other objects according to this invention are attained by providing a pair of fluid inlet ports and/or a pair of fluid outlet ports adapted to permit fluid communication between the rotor chamber and a fluid intake hole and/or between the rotor chamber and a fluid discharge hole.

The inlet ports have the equal shape and are positioned symmetrical with each other. Similarly, the outlet ports have equal shape and are positioned symmetrical with each other. These ports are defined by recesses formed in the inner surfaces of the end heads or sealing plates, or are defined by concave portions of the sealing plates concaved toward the end chambers. In case of providing inlet ports only, the discharge hole formed in the main body of the housing is extended into the rotor chamber, and similarly, in case of providing outlet ports only, the intake hole formed in the main body of the housing is extended into the rotor chamber. These and other objects of the invention will become apparent from the description of the drawings and the preferred embodiments which follow.

DETAILED DESCRIPTION OF THE PREFERRED EMBODIMENTS

Figure 1:
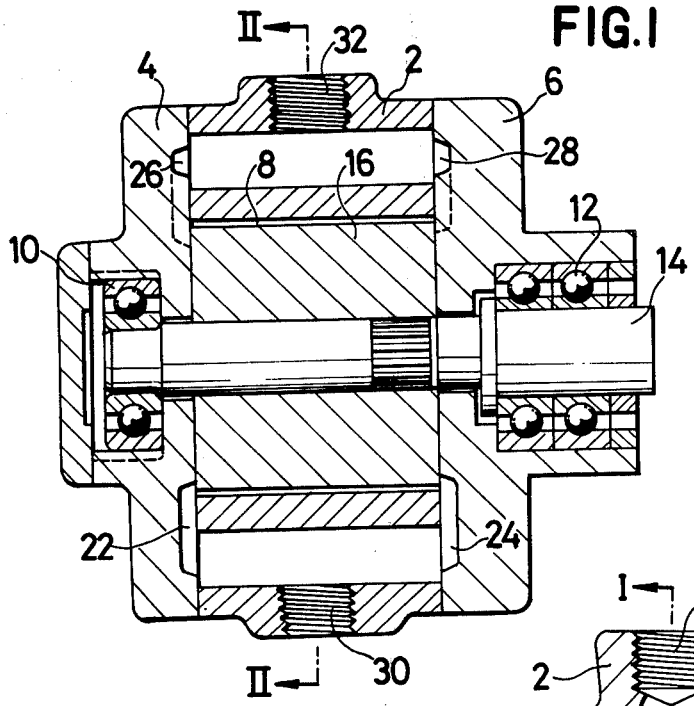
FIG. 1 shows a cross-sectional elevation taken along the line I—I of FIG. 2, illustrating a rotary fluid pump according to a first embodiment of this invention.
Figure 2:
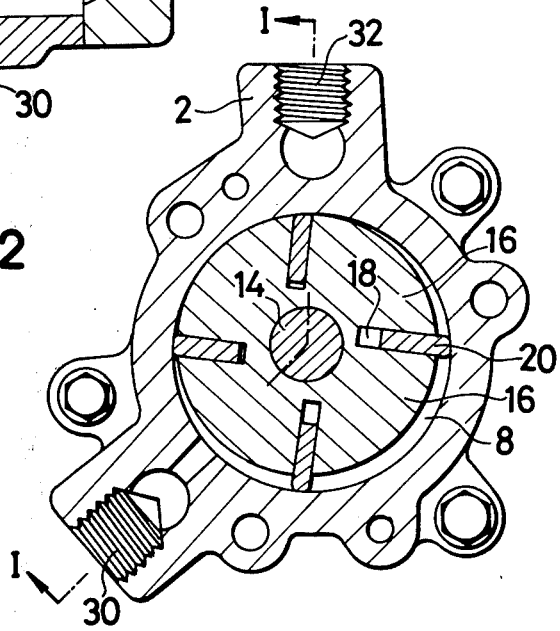
FIG. 2 shows a transverse cross-sectional elevation taken along the line II—II of FIG. 1.

A first embodiment of this invention is shown in FIGS. 1 and 2, wherein a rotor chamber 8 is defined by a main body of a stator housing 2 and a pair of end heads 4, 6 assembled at opposite sides of the housing 2 by bolts (not shown). A drive shaft 14 is eccentrically journalled by bearings 10, 12 and extends in the rotor chamber 8. A rotor 16 is mounted on the drive shaft 14 within the rotor chamber 8. The rotor 16 is formed with four radial vane grooves 18 having four vanes slidingly engaged therein.

Figure 3:
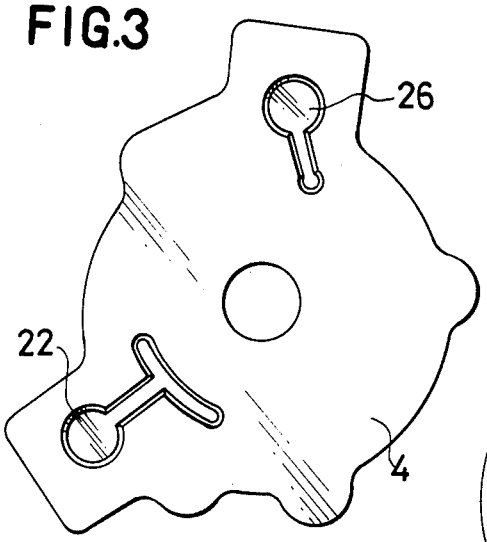
FIG. 3 shows a plan view of an end head formed with fluid inlet and discharge port used in the first embodiment shown in FIG. 1.

Each of the end heads 4, 6 is formed with inlet and outlet ports 22, 26, and inlet and outlet ports 24, 28, respectively. As shown in FIG. 3, these ports are defined by recessed portions formed in the inner surfaces of the end heads 4, 6. The shape of the recessed portions is not limited to those shown in FIG. 3. Rather, various shapes can be provided yet allowing desirable fluid communication between a fluid intake hole 30 formed in the housing 2 and the rotor chamber 2 and between the rotor chamber 2 and a fluid discharge hole 32 formed in the housing 2, through the inlets 22, 24, and the outlets 26, 28, respectively. The fluid intake hole 30 is connected to a fluid source (not shown) through a pipe (not shown).

As shown in FIG. 1, the confronting inlet ports 22, 24 formed in the inner surfaces of the opposite end heads 4, 6 have identical shapes with each other and are positioned symmetrical with each other. Similarly, the confronting outlet ports 26, 28 have identical shapes with each other and are positioned symmetrical with each other.

With this structure, fluid passing through the fluid intake hole 30 is introduced into the rotor chamber 8 through the inlet ports 22, 24 at an fluid amount substantially equal with each other. Hence, a substantially uniform fluid pressure is applied to both sides of the vanes 20 to thereby maintain balance of the vanes and local wear of the vanes is prevented.

Similarly, fluid in the rotor chamber 8 is discharged into the fluid discharge hole 32 through the outlet ports 26, 28 at discharge amounts substantially equal with each other. Substantially uniform fluid discharge pressures are therefore applied to the vanes.

Figure 4:
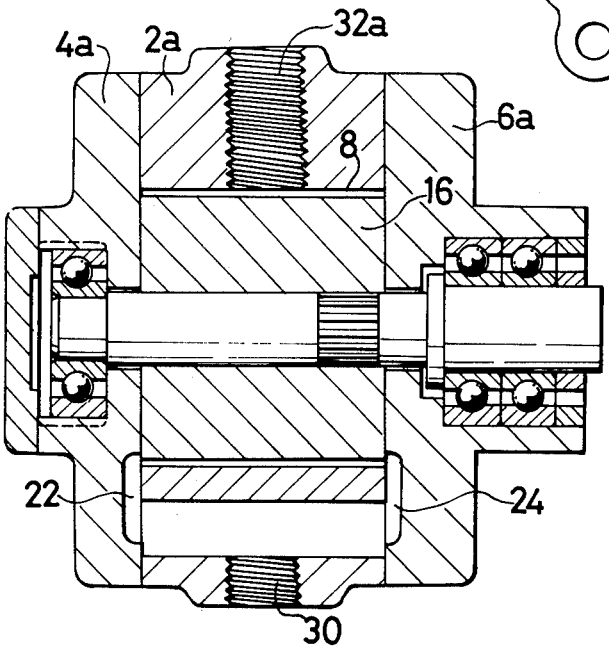
FIG. 4 shows a cross-sectional elevation of a rotary fluid pump according to a second embodiment of this invention.

A second embodiment according to this invention is shown in FIG. 4, wherein and in the subsequent drawings, like parts and components are designated by the same reference numerals and characters as those shown in the first embodiment.

According to the second embodiment, inlet ports 22, 24 are symmetrically formed in end heads 4*a*, 6*a*, respectively. However, outlet ports formed in the first embodiment are not provided in the end heads. Instead, a fluid discharge hole 32*a* formed in a main body of a housing 2*a* directly opens to the rotor chamber 8. Of course, the hole 32*a* is opened at the rotor chamber 8 at the position substantially at the longitudinally center portion of the rotor 16 to prevent the vanes 20 from local wear.

Figure 5:
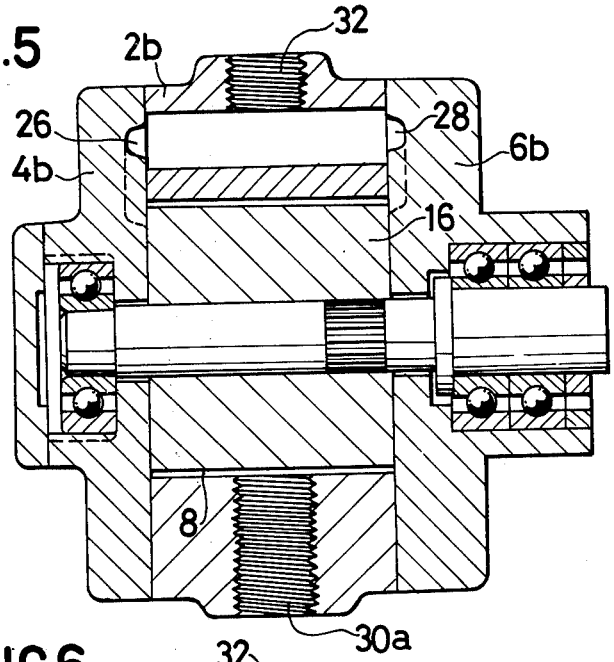
FIG. 5 shows a cross-sectional elevation of a rotor fluid pump according to a third embodiment of this invention.

On the other hand, according to the third embodiment illustrated in FIG. 5, outlet ports 26, 28 are symmetrically formed in end heads 4*b*, 6*b*, respectively. However inlet ports are not formed therein, and instead, a fluid intake hole 30*a* formed is in a main body of a housing 2*b* directly in communication with the rotor chamber 8 to introduce fluid from the fluid source thereinto. The intake hole 30*a* is also positioned at the longitudinal center portion of the rotor.

According to the second and third embodiments, vanes 20 are subject to a uniform fluid pressure at least during fluid intake operation (in the second embodiment) or at fluid discharge operation (in the third embodiment), to prevent the vanes from local wear. However, it is apparent that in the first embodiment having inlet and outlet ports at each of the end heads exhibits superior performance to that obtained in the second and third embodiments.

Figure 6:
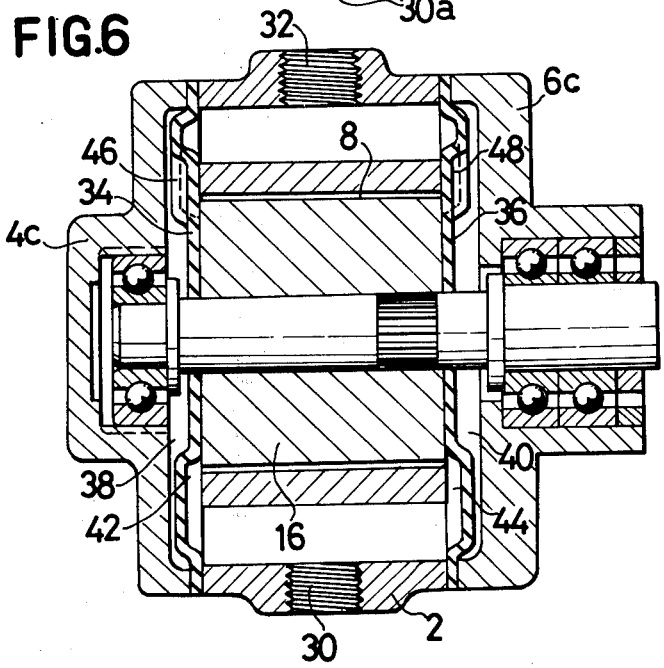
FIG. 6 shows a cross-sectional elevation of a rotary fluid pump according to a fourth embodiment of this invention.

A fourth embodiment according to this invention is shown in FIG. 6 wherein a pair of resilient sealing plates 34, 36 are individually disposed between the side faces of the housing 2 and recessed end heads 4*c*, 6*c*. Therefore the rotor chamber 8′ is defined between the sealing plates 34, 36, and a pair of end chambers 38, 40 are individually defined between the sealing plates 34, 36 and the recessed end heads 4*c*, 6*c*. Such structure is commonly seen in the fifth and sixth embodiments shown in FIGS. 7 and 8.

According to the fourth embodiment, each of the sealing plates 34, 36 is formed with inlet and outlet ports 42, 46 and 44, 48, respectively. These ports are defined by concave portions concaved toward the end chambers 38, 40. The inlet ports 42, 44 have identical shapes and are positioned symmetrical with each other. Similarly, the outlet ports 46, 48 have identical shapes and are positioned symmetrical with each other.

Other structures in the fourth embodiment are substantially equal to those shown in the first embodiment. For example, fluid intake and discharge holes 30, 32 are formed in the main body of the housing 2.

Figure 7:
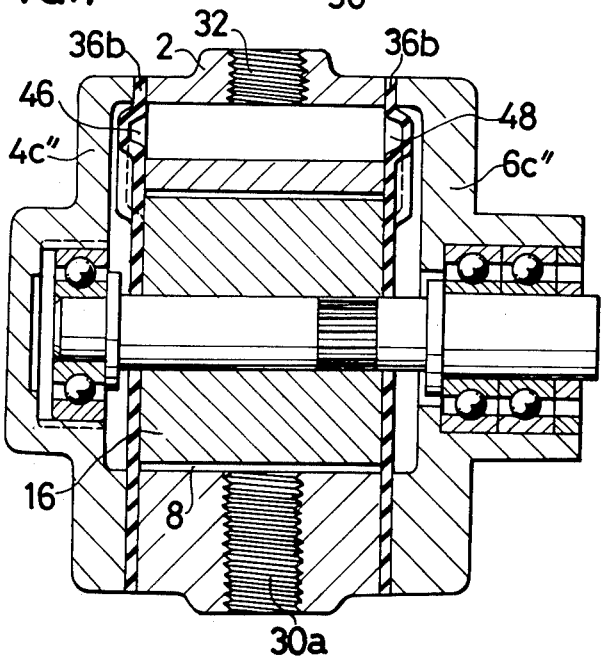
FIG. 7 shows a cross-sectional elevation of a rotary fluid pump according to a fifth embodiment of this invention.

A fifth embodiment according to this invention is shown in FIG. 7, wherein inlet ports 42, 44 are symmetrically formed in the sealing plates 34*a* and 36*a*, respectively. Instead of providing outlet ports in the respective sealing plates, a fluid discharge hole 32*a* extends into the rotor chamber 8 to directly discharge the fluid.

Figure 8:
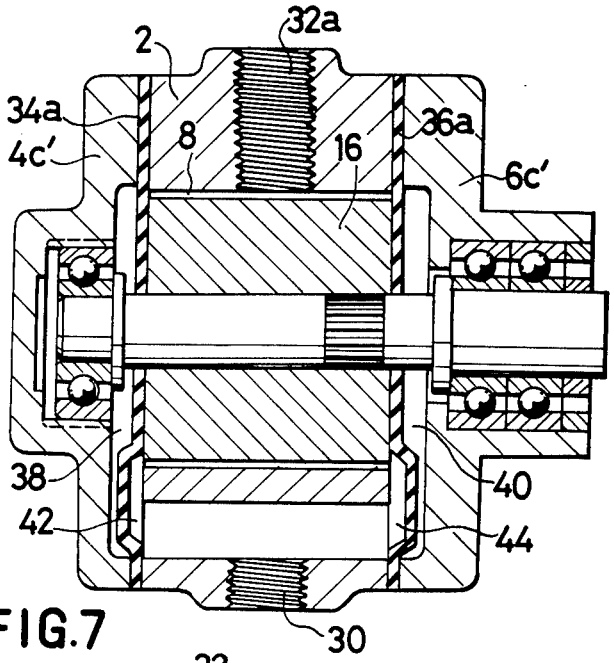
FIG. 8 shows a cross-sectional elevation of a rotary fluid pump according to a sixth embodiment of this invention.

A sixth embodiment according to this invention is shown in FIG. 8, wherein outlet ports 46, 48 are symmetrically formed in sealing plates 34*b*, 36*b*. Instead of providing inlet ports in the respective sealing plates, a fluid intake hole 30*a* extends into the rotor chamber 8 to directly introduce fluid therein.

Figure 9:
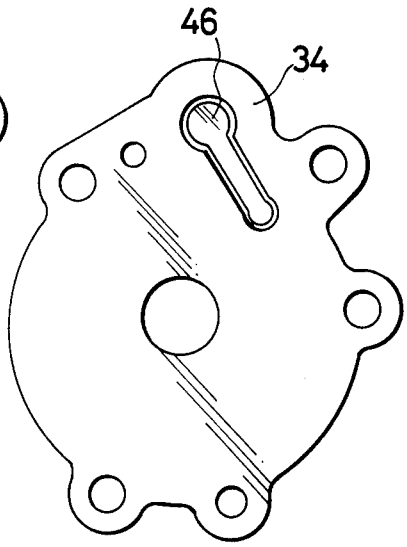
FIG. 9 shows a plan view of a sealing plate formed with a fluid outlet port used in the sixth embodiment shown in FIG. 8.

FIG. 9 shows the sealing plate 34*b* employed in the sixth embodiment. It is apparent that the sealing plate 34*b* is formed with the outlet port 4*b* whose shape is equal to the outlet port 48 formed in the sealing plate 36*b*. Furthermore, the outlet ports shown in the fourth embodiment (FIG. 6) have the equal shape to that shown in FIG. 9.

Alternatively, the inlet ports and/or outlet ports can be provided by the inner surface of the sealing plates being formed with recesses adapted to communicate the rotor chamber with the intake or discharge hole therethrough.

While the invention has been described in detail and with reference to specific embodiments thereof, various changes and modifications can be made therein without departing from the spirit and scope thereof.

What is claimed is:

1. In a rotary fluid pump, including a housing body, a pair of recessed end heads assembled to opposite ends of the housing; a pair of resilient sealing plates individually disposed between the side of the housing and the recessed end heads to provide a rotor chamber between the sealing plates and a pair of end chambers each defined between the sealing plate and the recessed end head; a rotor supported in the rotor chamber; and a plurality of vanes slidably disposed in vane grooves formed in the rotor, the improvement comprising; fluid inlet and outlet ports adapted to communicate with the rotor chamber, at least one of said fluid inlet port or said outlet port formed symmetrically in each of the resilient sealing plates, to provide a pair of ports, wherein fluid communication between said ports and said end chambers being prevented and, a fluid inlet hole and a fluid outlet hole arranged in said housing body at a position corresponding to the longitudinal center of said rotor.

2. The rotary fluid pump as defined in claim 1, wherein said inlet ports are defined by concave portions of the sealing plates, said concave portions being concaved toward the end heads and having substantially equal shape with each other.

3. The rotary fluid pump as defined in claim 1, wherein said outlet ports are defined by concave portions of the sealing plates, said concaved portion being concaved toward the end chambers and having an equal shape with each other.

4. The rotary fluid pump as defined in claim 1, wherein said inlet and outlet ports are defined by recessed grooves formed in the inner surfaces of the sealing plates.

5. The rotary fluid pump as defined in claim 1, wherein said inlet ports are defined by recessed portions symmetrically disposed on the confronting sealing plates to provide a pair of inlet ports.

6. The rotary fluid pump as defined in claims 1 or 5, wherein said outlet ports are defined by recessed portions symmetrically formed in the confronting sealing plates to define a pair of outlet ports, said outlet ports being positioned apart from the inlet ports.

* * * * *